US007663061B2

(12) United States Patent
Gareis et al.

(10) Patent No.: US 7,663,061 B2
(45) **Date of Patent: *Feb. 16, 2010**

(54) HIGH PERFORMANCE DATA CABLE

(75) Inventors: Galen Mark Gareis, Richmond, IN (US); Paul Z. Vanderlaan, Oxford, OH (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/877,343

(22) Filed: Oct. 23, 2007

(65) Prior Publication Data

US 2008/0041609 A1 Feb. 21, 2008

Related U.S. Application Data

(63) Continuation of application No. 09/765,914, filed on Jan. 18, 2001, now Pat. No. 7,339,116, which is a continuation-in-part of application No. 09/074,272, filed on May 7, 1998, now Pat. No. 6,222,130, and a continuation-in-part of application No. 08/629,509, filed on Apr. 9, 1996, now Pat. No. 5,789,711.

(51) Int. Cl.
*H01B 11/02* (2006.01)

(52) U.S. Cl. ..... 174/110 R; 174/113 R; 174/113 C; 174/113 AS

(58) Field of Classification Search ..... 174/110 R, 174/113 C, 113 R, 120 R, 131 AS, 131 A
See application file for complete search history.

(56) References Cited

U.S. PATENT DOCUMENTS

| | | | |
|---|---|---|---|
| 483,285 | A | 9/1892 | Guilleaume |
| 514,925 | A | 2/1894 | Guilleaume |
| 867,659 | A | 10/1907 | Hoopes et al. |

(Continued)

FOREIGN PATENT DOCUMENTS

| | | |
|---|---|---|
| DE | 697378 | 10/1940 |
| DE | 2459844 | 7/1976 |
| EP | 1 107 262 A2 | 6/2000 |

(Continued)

OTHER PUBLICATIONS

Bell Communications Research TA-TSY-00020, Issue 5, Aug. 1986.

(Continued)

*Primary Examiner*—William H Mayo, III
(74) *Attorney, Agent, or Firm*—Lando & Anastasi, LLP

(57) ABSTRACT

The present invention is for a high performance data cable which has an interior support or star separator. The star separator or interior support extends along the longitudinal length of the data cable. The star separator or interior support has a central region. A plurality of prongs or splines extend outward from the central region along the length of the central region. Each prong or spline is adjacent with at least two other prongs or splines. The prongs or splines may be helixed or S-Z shaped as they extend along the length of the star separator or interior support. Each pair of adjacent prongs or splines defines grooves which extend along the longitudinal length of the interior support. At least two of the grooves have disposed therein an insulated conductor. The interior support can have a first material and a different second material. The different second material forms an outer surface of the interior support.

21 Claims, 3 Drawing Sheets

U.S. PATENT DOCUMENTS 1,008,370 A 11/1911 Robillot
1,132,452 A 3/1915 Davis
1,700,606 A 1/1929 Beaver
1,940,917 A 12/1933 Okazaki
1,977,209 A 10/1934 Sargent
1,995,201 A 3/1935 Delon
2,149,772 A 3/1939 Hunter et al.
2,204,737 A 6/1940 Swallow et al.
2,218,830 A 10/1940 Rose et al.
2,501,457 A 3/1950 Thelin
2,538,019 A 1/1951 Lee
3,032,604 A 5/1962 Timmons
3,055,967 A 9/1962 Bondon
3,209,064 A 9/1965 Cutler
3,259,687 A 7/1966 Oatess et al.
3,588,313 A 6/1971 Delves-Broughton
3,603,715 A 9/1971 Vinnhorst et al.
3,610,814 A 10/1971 Peacock
3,621,118 A 11/1971 Bunish et al.
3,644,659 A 2/1972 Campbell
3,819,443 A 6/1974 Simons et al.
3,911,200 A 10/1975 Simons et al.
3,921,378 A 11/1975 Spicer et al.
3,927,247 A 12/1975 Timmons
4,038,489 A 7/1977 Stenson et al.
4,257,675 A 3/1981 Nakagome et al.
4,327,246 A 4/1982 Kincaid
4,361,381 A 11/1982 Williams
4,374,881 A 2/1983 Hamilton
4,385,485 A 5/1983 Yonechi
4,401,366 A 8/1983 Hope
4,446,689 A 5/1984 Hardin et al.
4,447,122 A 5/1984 Sutehall
4,456,331 A 6/1984 Whitehead et al.
4,474,426 A 10/1984 Yataki
RE32,225 E 8/1986 Neuroth et al.
4,661,406 A 4/1987 Gruhn et al.
4,683,349 A 7/1987 Takebe
4,710,594 A 12/1987 Walling et al.
4,719,319 A * 1/1988 Tighe, Jr. ..... 174/103
4,729,409 A 3/1988 Paul
4,755,629 A 7/1988 Beggs et al.
4,778,246 A 10/1988 Carroll
4,784,461 A 11/1988 Abe et al.
4,784,462 A 11/1988 Priaroggia
4,807,962 A * 2/1989 Arroyo et al. ..... 385/105
5,000,539 A 3/1991 Gareis
5,087,110 A 2/1992 Inagaki et al.
5,132,488 A * 7/1992 Tessier et al. ..... 174/34
5,149,915 A 9/1992 Brunker et al.
5,162,609 A 11/1992 Adriaenssens et al.
5,177,809 A 1/1993 Zeidler
5,212,350 A 5/1993 Gebs
5,289,556 A 2/1994 Rawlyk et al.
5,305,797 A 4/1994 Roy, Sr.
5,329,064 A 7/1994 Tash et al.
5,355,427 A 10/1994 Gareis et al.
5,444,184 A 8/1995 Hassel
5,486,649 A 1/1996 Gareis
5,557,698 A 9/1996 Gareis et al.
5,574,250 A * 11/1996 Hardie et al. ..... 174/36
5,670,748 A 9/1997 Gingue et al.
5,696,295 A * 12/1997 Wulff et al. ..... 568/724
5,699,467 A 12/1997 Kojima et al.
5,763,823 A 6/1998 Siekierka et al.
5,789,711 A 8/1998 Gaeris et al.
5,883,334 A 3/1999 Newmoyer et al.
5,952,615 A * 9/1999 Prudhon ..... 174/113 C
5,969,295 A 10/1999 Boucino et al.
6,074,503 A 6/2000 Clark et al.
6,091,025 A 7/2000 Cotter et al.
6,099,345 A 8/2000 Milner et al.
6,140,587 A 10/2000 Sackett
6,150,612 A * 11/2000 Grandy et al. ..... 174/113 C
6,162,992 A 12/2000 Clark et al.
6,222,130 B1 4/2001 Gareis et al.
6,248,954 B1 6/2001 Clark et al.
6,288,340 B1 9/2001 Armould
6,297,454 B1 10/2001 Gareis
6,300,573 B1 10/2001 Horie et al.
6,303,867 B1 10/2001 Clark et al.
6,310,295 B1 10/2001 Despard
6,365,836 B1 4/2002 Blouin et al.
6,506,976 B1 1/2003 Neveux, Jr.
6,596,944 B1 7/2003 Clark et al.
6,624,359 B2 9/2003 Bahlmann et al.
6,639,152 B2 10/2003 Glew et al.
6,686,537 B1 2/2004 Gareis et al.
6,687,437 B1 2/2004 Starnes et al.
6,770,819 B2 8/2004 Patel
6,787,697 B2 9/2004 Stipes et al.
6,800,811 B1 10/2004 Boucino
6,815,611 B1 11/2004 Gareis
6,818,832 B2 11/2004 Hopkinson et al.
6,855,889 B2 2/2005 Gareis
6,888,070 B1 5/2005 Prescott
6,897,382 B2 5/2005 Hager et al.
6,974,913 B2 12/2005 Bahlmann et al.
6,998,537 B2 2/2006 Clark et al.
7,049,523 B2 5/2006 Shuman et al.
7,064,277 B1 6/2006 Lique et al.
7,109,424 B2 9/2006 Nordin et al.
7,135,641 B2 11/2006 Clark
7,145,080 B1 12/2006 Boisvert et al.
7,154,043 B2 12/2006 Clark
7,196,271 B2 3/2007 Cornibert et al.
7,208,683 B2 4/2007 Clark
7,214,884 B2 5/2007 Kenny et al.
7,238,885 B2 7/2007 Lique et al.
7,244,893 B2 7/2007 Clark
7,339,116 B2 3/2008 Gareis et al.
7,358,436 B2 4/2008 Dellagala et al.
7,405,360 B2 7/2008 Clark et al.
7,534,964 B2 5/2009 Clark et al.
2003/0230427 A1 12/2003 Gareis
2004/0050578 A1 3/2004 Hudson
2006/0131058 A1 6/2006 Lique et al.
2006/0243477 A1 11/2006 Jean et al.
2007/0209823 A1 9/2007 Vexler et al.
2008/0041609 A1 2/2008 Gareis et al.
2008/0164049 A1 7/2008 Vexler et al.
2009/0133895 A1 5/2009 Allen
2009/0173514 A1 7/2009 Gareis

FOREIGN PATENT DOCUMENTS

EP 1 085 530 A2 3/2001
EP 1 162 632 A2 12/2001
GB 342606 2/1931
JP 1942-10582 9/1942
JP SHO56-1981-7307 1/1981
JP SHO56-1981-8011 1/1981
JP SHO61-1986-13507 1/1986
JP 04-332406 A * 11/1992
JP 4-332406 A 11/1992
JP 5-101711 4/1993
SU 1343447 10/1987
WO 9624143 A1 8/1996
WO 9848430 A1 10/1998
WO 0051142 A1 8/2000
WO 0079545 A1 12/2000
WO WO 0108167 A1 2/2001
WO 0154142 A1 7/2001
WO 03077265 A1 9/2003

| | | | |
|---|---|---|---|
| WO | WO 03094178 | A1 | 11/2003 |
| WO | 2005048274 | A2 | 5/2005 |

OTHER PUBLICATIONS

Hawley, The Condensed Chemical Dictionary, Tenth Edition, 1981, pp. 471, 840, 841.

Refi, James J., Fiber Optic Cable: A Lightguide, AT&T Specialized Series, Jan. 1991, pp. 79-80.

C&M Corporation Engineering Design Guide, 3rd Edition, 1992, p. 11.

* cited by examiner

HIGH PERFORMANCE DATA CABLE

The present application is a continuation of application Ser. No. 09/765,914 filed Jan. 18, 2001 now U.S. Pat. No. 7,339,116 which is a continuation-in-part of application Ser. No. 08/629,509 filed Apr. 9, 1996 now U.S. Pat. No. 5,789,711 and Ser. No. 09/074,272 filed May 7, 1998 now U.S. Pat. No. 6,222,130.

FIELD OF INVENTION

This invention relates to a high performance data cable utilizing twisted pairs. The data cable has an interior support or star separator around which the twisted pairs are disposed.

BACKGROUND OF THE INVENTION

Many data communication systems utilize high performance data cables having at least four twisted pairs. Typically, two of the twisted pairs transmit data and two of the pairs receive data. A twisted pair is a pair of conductors twisted about each other. A transmitting twisted pair and a receiving twisted pair often form a subgroup in a cable having four twisted pairs.

A high performance data cable utilizing twisted pair technology must meet exacting specifications with regard to data speed and electrical characteristics. The electrical characteristics include such things as controlled impedance, controlled near-end cross-talk (NEXT), controlled ACR (attenuation minus cross-talk) and controlled shield transfer impedance.

One way twisted pair data cables have tried to meet the electrical characteristics, such as controlled NEXT, is by utilizing individually shielded twisted pairs (ISTP). These shields insulate each pair from NEXT. Data cables have also used very complex lay techniques to cancel E and B fields to control NEXT. Finally, previous data cables have tried to meet ACR requirements by utilizing very low dielectric constant insulations. The use of the above techniques to control electrical characteristics has problems.

Individual shielding is costly and complex to process. Individual shielding is highly susceptible to geometric instability during processing and use. In addition, the ground plane of individual shields, 360.degree. in ISTP's, lessens electrical stability.

Lay techniques are also complex, costly and susceptible to instability during processing and use.

Another problem with many data cables is their susceptibility to deformation during manufacture and use. Deformation of the cable's geometry, such as the shield, lessens electrical stability. Applicant's unique and novel high performance data cable meets the exacting specifications required of a high performance data cable while addressing the above problems.

This novel cable has an interior support with grooves. Each groove accommodates at least one signal transmission conductor. The signal transmission conductor can be a twisted pair conductor or a single conductor. The interior support provides needed structural stability during manufacture and use. The grooves also improve NEXT control by allowing for the easy spacing of the twisted pairs. The easy spacing lessens the need for complex and hard to control lay procedures and individual shielding.

The interior support allows for the use of a single overall foil shield having a much smaller ground plane than individual shields. The smaller ground plane improves electrical stability. For instance, the overall shield improves shield transfer impedance. The overall shield is also lighter, cheaper and easier to terminate than ISTP designs.

The interior support can have a first material and a different second material. The different second material forms the outer surface of the interior support and thus forms the surface defining the grooves. The second material is generally a foil shield and helps to control electricals between signal transmission conductors disposed in the grooves. The second material, foil shield, is used in addition to the previously mentioned overall shield.

This novel cable produces many other significant advantageous results such as:

improved impedance determination because of the ability to precisely place twisted pairs;

the ability to meet a positive ACR value from twisted pair to twisted pair with a cable that is no larger than an ISTP cable; and an interior support which allows for a variety of twisted pair dimensions.

Previous cables have used supports designed for coaxial cables. The supports in these cables are designed to place the center conductor coaxially within the outer conductor. The supports of the coaxial designs are not directed towards accommodating signal transmission conductors. The slots in the coaxial support remain free of any conductor. The slots in the coaxial support are merely a side effect of the design's direction to center a conductor within an outer conductor with a minimal material cross section to reduce costs. In fact, one would really not even consider these coaxial cable supports in concurrence with twisted pair technology.

SUMMARY OF THE INVENTION

In one embodiment, we provide a data cable which has a one piece plastic interior support. The interior support extends along the longitudinal length of the data cable. The interior support has a central region which extends along the longitudinal length of the interior support. The interior support has a plurality of prongs. Each prong is integral with the central region. The prongs extend along the longitudinal length of the central region and extend outward from the central region. The prongs are arranged so that each prong of said plurality is adjacent with at least two other prongs.

Each pair of adjacent prongs define a groove extending along the longitudinal length of the interior support. The prongs have a first and second lateral side. A portion of the first lateral side and a portion of the second lateral side of at least one prong converge towards each other.

The cable further has a plurality of insulated conductors disposed in at least two of the grooves.

A cable covering surrounds the interior support. The cable covering is exterior to the conductors.

Applicants' inventive cable can be alternatively described as set forth below. The cable has an interior support extending along the longitudinal length of the data cable. The interior support has a central region extending along the longitudinal length of the interior support. The interior support has a plurality of prongs. Each prong is integral with the central region. The prongs extend along the longitudinal length of the central region and extend outward from the central region. The prongs are arranged so that each prong is adjacent with at least two other prongs.

Each prong has a base. Each base is integral with the central region. At least one of said prongs has a base which has a horizontal width greater than the horizontal width of a portion of said prong above said base. Each pair of the adjacent prongs defines a groove extending along the longitudinal length of the interior support.

A plurality of conductors is disposed in at least two of said grooves.

A cable covering surrounds the interior support. The cable covering is exterior to the conductors.

The invention can further be alternatively described by the following description. An interior support for use in a high-performance data cable. The data cable has a diameter of from about 0.300" to about 0.400". The data cable has a plurality of insulated conductor pairs.

The interior support in said high-performance data cable has a cylindrical longitudinally extending central portion. A plurality of splines radially extend from the central portion. The splines also extend along the length of the central portion. The splines have a triangular cross-section with the base of the triangle forming part of the central portion, each triangular spline has the same radius. Adjacent splines are separated from each other to provide a cable chamber for at least one pair of conductors. The splines extend longitudinally in a helical, S, or Z-shaped manner.

An alternative embodiment of applicant's cable can include an interior support having a first material and a different second material. The different second material forms an outer surface of the interior support. The second material conforms to the shape of the first material. The second material can be referred to as a conforming shield because it is a foil shield which conforms to the shape defined by the outer surface of the first material.

Accordingly, the present invention desires to provide a data cable that meets the exacting specifications of high performance data cables, has a superior resistance to deformation during manufacturing and use, allows for control of near-end cross talk, controls electrical instability due to shielding, and can be a 300 MHz cable with a positive ACR ratio.

It is still another desire of the invention to provide a cable that does not require individual shielding, and that allows for the precise spacing of conductors such as twisted pairs with relative ease.

It is still a further desire of the invention to provide a data cable that has an interior support that accommodates a variety of AWG's and impedances, improves crush resistance, controls NEXT, controls electrical instability due to shielding, increases breaking strength, and allows the conductors such as twisted pairs to be spaced in a manner to achieve positive ACR ratios.

Other desires, results, and novel features of the present invention will become more apparent from the following drawing and detailed description and the accompanying claims.

DETAILED DESCRIPTION

The following description will further help to explain the inventive features of this cable.

Figure 1:
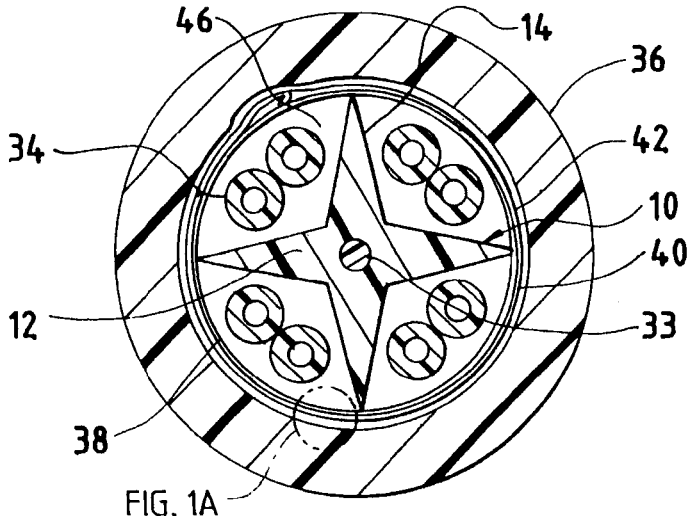
FIG. 1 is a vertical cross-sectional view taken along a plane of one embodiment of this invention.
Figure 1A:
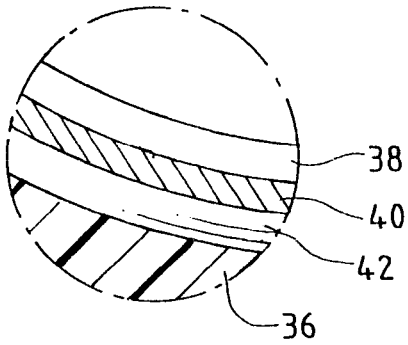
FIG. 1*a* is a blow up of a portion of the cross section shown in FIG. 1.
Figure 2:
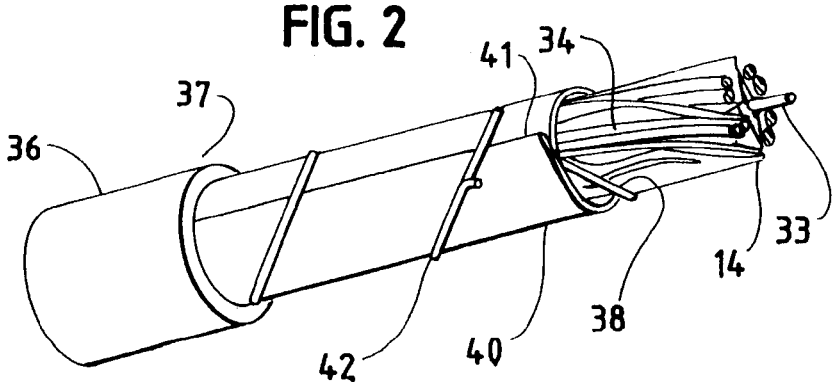
FIG. 2 is a top right perspective view of this invention. The view shows the cable cut away to expose its various elements. The view further shows the helical twist of the prongs or splines.

FIG. 1 is a vertical cross-section of one embodiment of this novel cable. The shown embodiment has an interior support or star separator (10). The interior support or star separator runs along the longitudinal length of the cable as can be seen in FIG. 2. The interior support or star separator, hereinafter, in the detailed description, both referred to as the "star separator", has a central region (12) extending along the longitudinal length of the star separator. The star separator has four prongs or splines. Each prong or spline (14), hereinafter in the detailed description both referred to as splines, extends outward from the central region and extends along the longitudinal length of the central region. The splines are integral with the central region. Each spline has a base portion (15). Each base portion is integral with the central region. Each spline has a base portion which has a horizontal width greater than the horizontal width of a portion of said spline above said base.

Each spline also has a first lateral side (16) and a second lateral side (17). The first and second lateral sides of each spline extend outward from the central region and converge towards each other to form a top portion (18). Each spline has a triangular cross section with preferably an isosceles triangle cross section. Each spline is adjacent with at least two other splines. For instance, spline (14) is adjacent to both adjacent spline (20) and adjacent spline (21).

The first lateral side of each spline is adjacent with a first or a second lateral side of another adjacent spline. The second lateral side of each spline is adjacent to the first or second side of still another adjacent spline.

Figure 3:
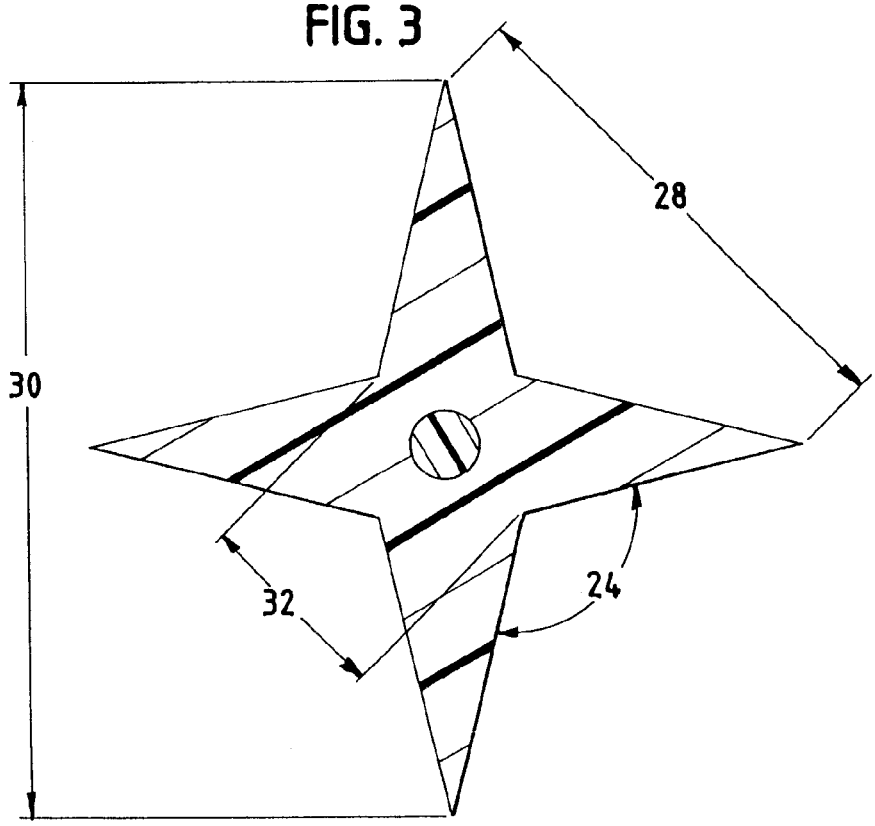
FIG. 3 is a vertical cross-section of the interior support or star separator showing some of the dimensions of the interior support or star separator.
Figure 4:
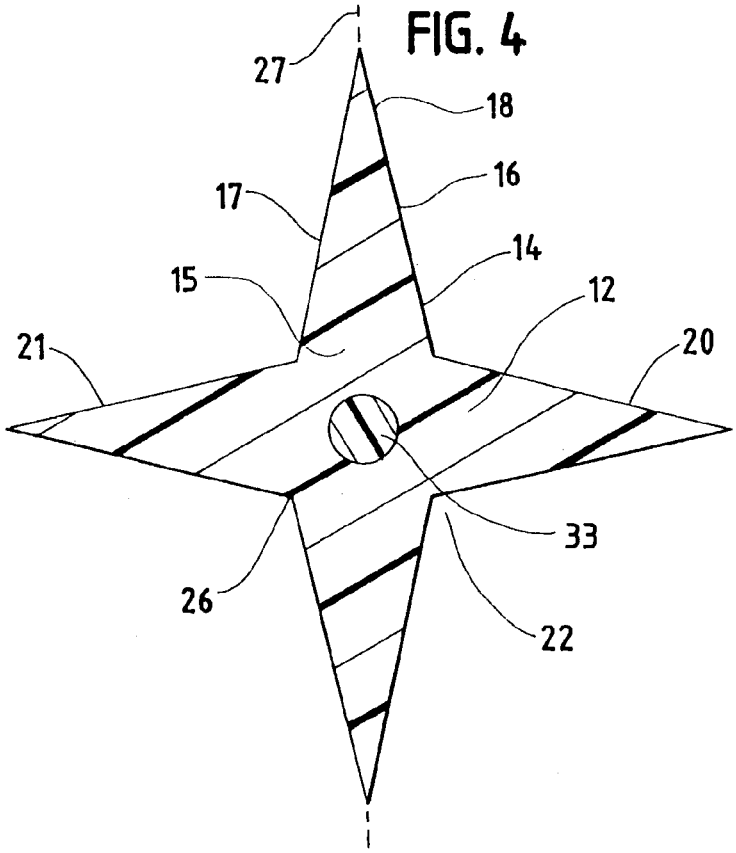
FIG. 4 is a vertical cross-section of the interior or star separator support showing the features of the prongs or splines.

Each pair of adjacent splines defines a groove (22). The angle (24) of each groove is greater than 90°. The adjacent sides are angled towards each other so that they join to form a crevice (26). The groove extends along the longitudinal length of the star separator. The splines are arranged around the central region so that a substantial congruency exists along a straight line (27) drawn through the center of the horizontal cross section of the star separator. Further, the splines are spaced so that each pair of adjacent splines has a distance (28), measured from the center of the top of one spline to the center of the top of an adjacent spline (top to top distance) as shown in FIG. 3. The top to top distance (28) being substantially the same for each pair of adjacent splines.

In addition, the shown embodiment has a preferred "tip to crevice" ratio of between about 2.1 and 2.7. Referring to FIG. 3. The "tip distance" (30) is the distance between two top portions opposite each other. The "crevice distance" (32) is the distance between two crevices opposite each other. The ratio is measured by dividing the "tip" distance by the "crevice" distance.

The specific "tip distance", "crevice distance" and "top to top" distances can be varied to fit the requirements of the user such as various AWG's and impedances. The specific material for the star separator also depends on the needs of the user such as crush resistance, breaking strengths, the need to use gel fillings, the need for safety, and the need for flame and smoke resistance. One may select a suitable copolymer. The star separator is solid beneath its surface.

A strength member may be added to the cable. The strength member (33) in the shown embodiment is located in the central region of the star separator. The strength member runs the longitudinal length of the star separator. The strength member is a solid polyethylene or other suitable plastic, textile (nylon, aramid, etc.), fiberglass (FGE rod), or metallic material.

Conductors, such as the shown insulated twisted pairs, (34) are disposed in each groove. The pairs run the longitudinal length of the star separator. The twisted pairs are insulated with a suitable copolymer. The conductors are those normally used for data transmission. The twisted pairs may be Belden's DATATWIST 350 twisted pairs. Although the embodiment utilizes twisted pairs, one could utilize various types of insulated conductors with the star separator.

The star separator may be cabled with a helixed or S-Z configuration. In a helical shape, the splines extend helically along the length of the star separator as shown in FIG. 2. The helically twisted splines in turn define helically twisted conductor receiving grooves which accommodate the twisted pairs.

The cable (37) as shown in FIG. 2 is a high performance shielded 300 Mhz data cable. The cable has an outer jacket (36), e.g., polyvinyl chloride.

Over the star separator is a polymer binder sheet (38). The binder is wrapped around the star separator to enclose the twisted pairs. The binder has an adhesive on the outer surface to hold a laterally wrapped shield (40). The shield (40) is a tape with a foil or metal surface facing towards the interior of the jacket. The shield in the shown embodiment is of foil and has an overbelt (shield is forced into round smooth shape) (41) which may be utilized for extremely well controlled electricals. A metal drain wire (42) is spirally wrapped around the shield. The drain spiral runs the length of the cable. The drain functions as a ground.

My use of the term "cable covering" refers to a means to insulate and protect my cable. The cable covering being exterior to said star member and insulated conductors disposed in said grooves. The outer jacket, shield, drain spiral and binder described in the shown embodiment provide an example of an acceptable cable covering. The cable covering, however, may simply include an outer jacket.

The cable may also include a gel filler to fill the void space (46) between the interior support, twisted pairs and a part of the cable covering.

Figure 5:
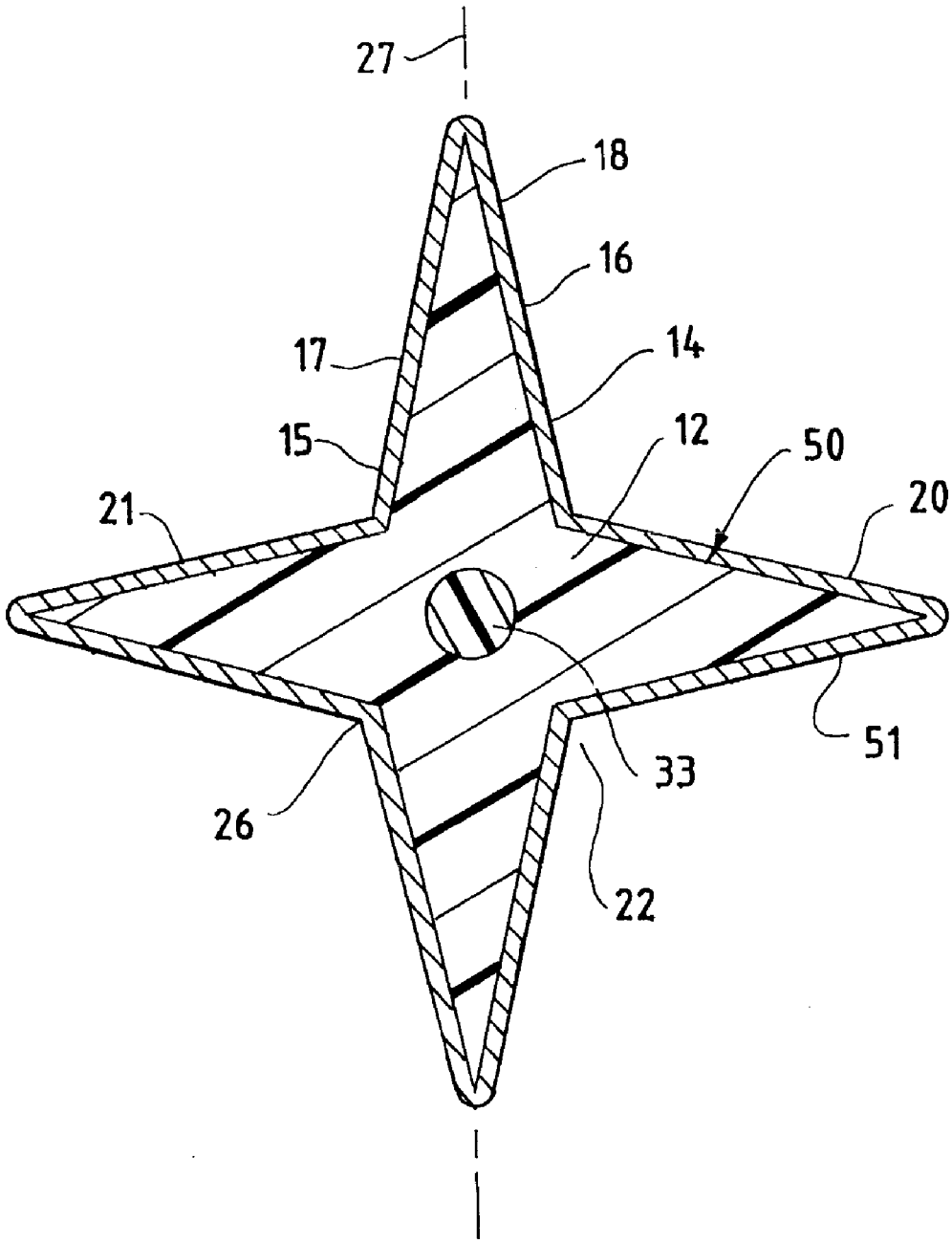
FIG. 5 is a vertical cross-section of an alternative embodiment of an interior support or star separator showing the conforming foil shield which makes up the second material of the interior support.

An alternative embodiment of the cable utilizes an interior support having a first inner material (50) and a different second outer material (51) (see FIG. 5). The second material is a conforming shield which conforms to the shape defined by the outer surface of the first material (50). The conforming shield is a foil shield. The foil shield should have enough thickness to shield the conductors from each other. The shield should also have sufficient thickness to avoid rupture during conventional manufacture of the cable or during normal use of the cable. The thickness of the conforming shield utilized was about 3 mm. The thickness could go down to even 0.3 mm. Further, although the disclosed embodiment utilizes a foil shield as the conforming shield, the conforming shield could alternatively be a conductive coating applied to the outer surface of the first material (50).

To conform the foil shield (51) to the shape defined by the first material's (50) outer surface, the foil shield (51) and an already-shaped first material (50) are placed in a forming die. The forming die then conforms the shield to the shape defined by the first material's outer surface.

The conforming shield can be bonded to the first material. An acceptable method utilizes heat pressure bonding. One heat pressure bonding technique requires utilizing a foil shield with an adhesive vinyl back. The foil shield, after being conformed to the shape defined by the first material's outer surface, is exposed to heat and pressure. The exposure binds the conforming shield (51) to the outer surface of the first material (50).

A cable having an interior support as shown in FIG. 5 is the same as the embodiment disclosed in FIG. 1 except the alternative embodiment in FIG. 5 includes the second material, the conforming shield (51), between the conductors and the first material (50).

The splines of applicants' novel cable allow for precise support and placement of the twisted pairs. The star separator will accommodate twisted pairs of varying AWG's and impedance. The unique triangular shape of the splines provides a geometry which does not easily crush.

The crush resistance of applicants' star separator helps preserve the spacing of the twisted pairs, and control twisted pair geometry relative to other cable components. Further, adding a helical or S-Z twist improves flexibility while preserving geometry.

The use of an overall shield around the star separator allows a minimum ground plane surface over the twisted pairs, about 45° of covering. The improved ground plane provided by applicant' shield, allows applicant' cable to meet a very low transfer impedance specification. The overall shield may have a more focused design for ingress and egress of cable emissions and not have to focus on NEXT duties.

The strength member located in the central region of the star separator allows for the placement of stress loads away from the pairs.

It will, of course, be appreciated that the embodiment which has just been described has been given by way of illustration, and the invention is not limited to the precise embodiments described herein; various changes and modifications may be effected by one skilled in the art without departing from the scope or spirit of the invention as defined in the appended claims.

The invention claimed is:

1. A communications cable comprising:

a plurality of twisted pairs that carry communications signals;

a pair separator disposed among the plurality of twisted pairs, the pair separator comprising a central body portion and a plurality of arms radially extending from the central body portion, each pair of adjacent arms defining a channel; and a cable covering surrounding the plurality of twisted pairs and the pair separator along the length of the cable;

wherein at least one twisted pair of the plurality of twisted pairs is respectively located in the channel defined by each pair of adjacent arms;

wherein the plurality of twisted pairs and the pair separator are helically twisted together along the length of the cable; and wherein the cable covering does not include an electrically conductive shield.

2. The communications cable as claimed in claim 1, wherein the plurality of twisted pairs consists of four twisted pairs.

3. The communications cable as claimed in claim 2, wherein the plurality of arms consists of four arms.

4. The communications cable as claimed in claim 1, wherein a single twisted pair is respectively located in the channel defined by each pair of adjacent arms.

5. The communications cable as claimed in claim 1, wherein the pair separator consists of a dielectric material.

6. The communications cable as claimed in claim 1, wherein the communications cable is about 0.300 to 0.400 is diameter.

7. A communications cable comprising:

a plurality of twisted pairs that carry communications signals;

a pair separator disposed among the plurality of twisted pairs, the pair separator comprising a central body portion and a plurality of arms radially extending from the central body portion, each pair of adjacent arms defining a channel; and a jacket surrounding the plurality of twisted pairs and the pair separator along the length of the cable;

wherein at least one twisted pair of the plurality of twisted pairs is respectively located in the channel defined by each pair of adjacent arms;

wherein the jacket and the pair separator together maintain the plurality of twisted pairs in the respective channels; and wherein the communications cable does not include an electrically conductive shield.

8. The communications cable as claimed in claim 7, wherein the plurality of twisted pairs consists of four twisted pairs.

9. The communications cable as claimed in claim 8, wherein the plurality of arms consists of four arms.

10. The communications cable as claimed in claim 7, wherein a single twisted pair is respectively located in the channel defined by each pair of adjacent arms.

11. The communications cable as claimed in claim 7, wherein pair separator consists of a dielectric material.

12. A data communications cable comprising:

a plurality of twisted pairs that carry data communications signals;

a dielectric interior support having a central body portion and a plurality of arms extending from the central body portion, each pair of adjacent arms of the plurality of arms defining a channel; and a cable covering that surrounds the plurality of twisted pairs and the dielectric interior support along the length of the data communications cable;

wherein the dielectric interior support is configured in combination with the cable covering to maintain the plurality of twisted pairs within the channels defined by the plurality of arms of the dielectric interior support; and wherein the plurality of twisted pairs and the dielectric interior support are helically twisted together along the length of the data communications cable.

13. The data communications cable as claimed in claim 12, wherein the plurality of twisted pairs consists of four twisted pairs.

14. The data communications cable as claimed in claim 13, wherein the plurality of arms consists of four arms defining four channels.

15. The data communications cable as claimed in claim 14, wherein one twisted pair of the plurality of twisted pairs is respectively disposed in each one channel.

16. The data communications cable as claimed in claim 12, wherein the cable covering does not include an electrically conductive shield.

17. The data communications cable as claimed in claim 12, wherein each arm of the plurality of arms is adjacent to two other arms.

18. The data communications cable as claimed in claim 12, wherein the cable covering does not include an electrically conductive shield.

19. A data communications cable comprising:

a plurality of twisted pairs;

an interior support comprising a longitudinally extending central portion and a plurality of arms radially extending from the central portion along the length of the central portion, each arm of the plurality of arms being adjacent to two other arms of the plurality of arms, the plurality of arms forming a plurality of pairs of adjacent arms, the plurality of pairs of adjacent arms defining a corresponding plurality of grooves; and a jacket covering the plurality of twisted pairs and the interior support along the length of the data communications cable;

wherein one twisted pair of the plurality of twisted pairs is respectively located in each groove of the plurality of grooves; and wherein the plurality of twisted pairs and the interior support are helically twisted together along the length of the data communications cable; and wherein the data communications cable does not include an electrically conductive shield surrounding the plurality of twisted pairs.

20. The data communications cable as claimed in claim 19, wherein the interior support consists of a dielectric material.

21. The communications cable as claimed in claim 7, wherein the pair separator and the plurality of twisted pairs are cabled in an S-Z configuration.

* * * * *